United States Patent [19]

Lovas et al.

[11] Patent Number: 4,819,420

[45] Date of Patent: Apr. 11, 1989

[54] PROCESS AND DEVICE FOR PIECING TO AN OPEN-END FRICTION SPINNING DEVICE

[75] Inventors: Kurt Lovas, Bohmfeld; Werner Billner, Ingolstadt, both of Fed. Rep. of Germany

[73] Assignee: Schubert & Salzer, Ingolstadt, Fed. Rep. of Germany

[21] Appl. No.: 30,853

[22] PCT Filed: Jun. 5, 1986

[86] PCT No.: PCT/DE86/00235

§ 371 Date: Apr. 13, 1987

§ 102(e) Date: Apr. 13, 1987

[87] PCT Pub. No.: WO87/00215

PCT Pub. Date: Jan. 15, 1987

[30] Foreign Application Priority Data

Jun. 24, 1985 [DE] Fed. Rep. of Germany ..... 3522517

[51] Int. Cl.[4] ..... D01H 15/02

[52] U.S. Cl. ..... 57/263; 57/401

[58] Field of Search ..... 57/261–263, 57/401

[56] References Cited

U.S. PATENT DOCUMENTS

| | | | |
|---|---|---|---|
| 4,107,911 | 8/1978 | Yamana et al. | 57/56 |
| 4,125,990 | 11/1978 | Stahlecker et al. | 57/263 |
| 4,559,774 | 12/1985 | Stahlecker | 57/263 |
| 4,561,242 | 12/1985 | Stahlecker | 57/263 |
| 4,563,872 | 1/1986 | Stahlecker | 57/263 |
| 4,570,430 | 2/1986 | Stahlecker | 57/263 |
| 4,598,539 | 7/1986 | Stahlecker et al. | 57/263 |

FOREIGN PATENT DOCUMENTS

| | | |
|---|---|---|
| 3141188 | 6/1982 | Fed. Rep. of Germany . |
| 3307082 | 9/1984 | Fed. Rep. of Germany . |
| 3323189 | 1/1985 | Fed. Rep. of Germany . |
| 1528642 | 10/1978 | United Kingdom . |

*Primary Examiner*—John Petrakes

*Attorney, Agent, or Firm*—Dority & Manning

[57] ABSTRACT

In order to piece to an open-end friction spinning device with two friction spinning elements driven in the same direction and forming a nip subjected to suction, fibers fed into such nip are twisted into a fiber bundle. The fiber bundle is partially conveyed out of the nip in a longitudinal direction, grasped there, and then transferred to a winding device. An auxiliary conveying device is provided to convey the fiber bundle from a thread forming zone adjacent the spinning element nip up to the draw-off side end of such friction spinning elements. A grabber is provided to grasp the fiber bundle as it leaves such nip of the friction spinning elements and to transfer the forming thread to a draw-off device.

39 Claims, 5 Drawing Sheets

PROCESS AND DEVICE FOR PIECING TO AN OPEN-END FRICTION SPINNING DEVICE

BACKGROUND OF THE INVENTION

The present invention relates to a process and device for piecing to an open-end friction spinning device having two friction spinning elements which are driven in the same direction and form a nip that is subjected to suction, in which fibers are fed into the nip, into a thread forming zone, from which they are drawn off again in the form of a continuous thread.

According to a process which is known in rotor spinning, the spinning station is supplied with a tube equipped with a winding for piecing, or lead winding when the bobbin is to be replaced (CH-PS No. 618.741), which corresponds with U.S. Pat. No. 4,125,990. To piece thread to the spinning aggregate, the thread of this piecing or lead winding is fed to the spinning aggregate and is then drawn off, whereby the piecing joint reaches the tube.

DE-OS No. 2.501.735 also teaches to separate the thread segment containing the piecing joint from the thread and to aspire it into the opening of a thread draw-off pipe. To achieve this, piecing is effected in this known art with the help of an auxiliary thread supplied from a piecing bobbin which is carried along by a travelling bobbin replacement device. Also, according to this art, the thread is first transferred to the empty bobbin and the thread segment containing the piecing joint is then separated and taken away. This means that in this state of the art a special piecing device is required for bobbin replacement, in addition to the normal piecing device.

It is therefore the task of the present invention to create a device making it possible to effect piecing by a simple method and without requiring a piecing thread. This goal is achieved with practice of this invention in that the fibers fed into the nip are twisted into a fiber bundle and in that said fiber bundle is partially conveyed out of the nip in its longitudinal direction, to be siezed at that point and to be transferred to a winding device. A piecing thread is thus not required, since the fiber bundle produced in the open-end friction spinning device is itself seized and drawn off. Thus a bobbin can be newly started without auxiliary thread which must otherwise be held in readiness on an auxiliary bobbin or on the empty tube, and the device for storing such auxiliary bobbins or devices to supply the piecing winding are not needed. The piecing process, when a bobbin is started, can be thus carried out in the simplest way possible and with little mechanical or time expenditure.

Preferably, the fiber bundle is separated from the remaining thread before the transfer of the thread to the winding device takes place. The piecing joint, constituting a defect, is thus eliminated. The thread which is now transferred to the empty spool thus does not contain any piecing joint. To achieve this goal, no flying bobbin replacement is required, so that maintenance of the spinning device can be combined with bobbin replacement without adverse effect upon the new bobbin.

In a practical version of the process according to invention, fiber feeding is switched off after the formation of the fiber bundle, the fiber bundle is then partially taken out of the nip of the friction spinning elements by pneumatic means, is seized at that point and is secured against twisting at its leading end, whereupon fiber feeding is resumed and the newly produced thread is drawn off from the nip. Through the temporary interruption of fiber feeding, individual fibers are prevented from entering the nip during pneumatic conveying of the fiber bundle, as they would otherwise leave the nip immediately. This interruption of fiber feeding does not effect secure piecing; besides, a possible shortage in fibers can be compensated for by appropriately timing the fiber bundle's staying time in the nip once its leading end has been secured against twisting by controlling the rotational speed of the friction spinning elements, etc.

Pneumatic conveying of the fiber bundle can be carried out in various manners. In a preferred version of the process according to this invention, the fiber bundle is partially pulled out of the nip by a suction air stream acting upon the draw-off side of the nip, whereupon the leading end of the fiber bundle is temporarily applied against a twist brake after it has left the nip, and is again released from the twist brake with the newly produced thread being drawn off from the nip. Alternately, it is also possible to produce a compressed air stream and to blow the fiber bundle partially out of the nip so that it can be seized.

To carry out this process, an auxiliary conveying installation to convey the fiber bundle from the thread forming zone up to the draw-off end of the friction elements is provided, as is a grabber to seize the fiber bundle leaving the nip of the friction spinning elements and to transfer the thread being formed to a draw-off device. The auxiliary conveyor ensures that the fiber bundle is presented to the grabber and is taken up while the grabber, by seizing the leading end of the fiber bundles, prevents it from rotating in the seizing zone, so that true twisting is produced in the remaining length of the fiber bundle as required in order to twist and incorporate the newly fed fibers into the thread. The newly formed thread is then transferred to a draw-off device to be drawn off continuously from the thread forming zone.

To prevent the piecing joint formed by the fiber bundle from reaching the newly inserted empty tube, the grabber can be equipped with a thread cutting device in a further embodiment of the object of the invention, by means of which this joint can be cut from the remainder of the thread.

The grabber can be designed in different ways. It is conceivable, for instance, to install a stationary grabber at the draw-off side of the open-end friction spinning elements. A transfer device can serve as the draw-off device to which the thread is fed by means of a hoop or similar device or which fetches the thread from the grabber, draws it off and presents it to the bobbin station by means of an appropriate movement. Preferably however, the grabber itself is designed to move, whereby the draw-off device rwhich receives the newly formed thread is constituted by the winding device. A simple embodiment fulfilling objects of this invention is thus achieved.

In an advantageous embodiment of the device according to this invention the grabber is fashioned as the mouth of a suction pipe in front of which a twist brake is installed. The suction pipe serves to take up the thread while the twist brake prevents the leading end of the fiber bundle from twisting. In a simple embodiment in accordance with this invention, the twist brake is a mechanical device and is constituted by a surface with a high friction coefficient against which the thread is applied. In addition to or instead of this design of the twist brake as a surface with a high friction coefficient against which the thread is applied, provisions can be made according to invention for the twist brake to be constituted by a sieve subjected to negative air pressure, extending parallel to the conveying direction of the fiber bundle to the suction pipe when the suction pipe is in receiving position.

In order to release the newly formed thread from the twist brake after completed piecing so that it may then be sucked into the suction pipe, said suction pipe is preferably equipped with a switch-over device for the alternate application of negative pressure to the sieve or to the mouth of the suction pipe. In a space-saving embodiment the thread cutting device preferably doubles as the switch-over device.

When the thread forming zone is located in the nip on the other side of the clamping line between the friction spinning elements, opposite to the nip into which the fibers are fed, it is necessary to cover the thread forming zone during piecing and spinning. In this instance the thread forming zone lies open so that the piecing joint does not have to be fed in axial direction of the thread depositing surface. To ensure rather than the thread is rather taken up from the side, a further practical embodiment in accordance with this invention provides for the twist brake to be wedge-shaped in adaptation to the thread forming zone of the friction spinning elements. In this case the twist brake is preferably adjustable with respect to the mouth of the suction pipe as said twist brake is then not limited to the application to only one end of the thread forming zone.

For the piecing joint to be transferred to the mouth of the suction pipe after being taken out of the thread forming zone, provisions are preferably made to prevent such movements in the air stream sucked into the mouth as would be directed counter to the twist brake, so that the piecing joint may be detached easily from the twist brake. For this purpose the mouth of the suction pipe is surrounded by radial clearance. The air fed to the mouth of the suction pipe thus flows axially, and not radially against the twist brake in the latter's vicinity. To ensure this, the axially adjustable twist brake is, in its transferring position, at axial distance from the mouth of the suction pipe.

Instead of a pneumatic grabber, it is also possible to provide a mechanical grabber, consisting preferably of at least two elements which can be moved in relation to each other so as to assume a holding position or a releasing position. For example, one of the elements is constituted by a plurality of garniture needles while the other, movable element is a scraper which moves in the direction of the needle points so as to free the thread previously caught by the garniture needles. The grabber is preferably fashioned as a thread clamp since this is a simple embodiment of the grabber and makes secure release of the thread possible.

As mentioned, it is possible, in accordance with this invention, to produce bobbin beginnings without piecing joints. After beginning of the bobbin however, thread breakgage may occur, and these breaks can then be repaired in the conventional manner without a new bobbin having to be started. For this purpsoe a preferred embodiment in accordance with this invention provides for a thread piecing device, e.g. a knotting or splicing device, to be inserted in the path of the thread between the open-end friction spinning device and the winding device, by means of which the newly pieced thread can be attached to a thread end pulled from the bobbin. However, the device according to this invention is preferably configured so as to make it possible, on the one hand, to piece without piecing thread at the beginning of winding, while not excluding the possibility, on the other hand, of pulling the thread from the bobbin for the purpose of piecing and presentation to the spinning device when thread breakage is to be repaired. In such case it is of advantage if the grabber doubles as a thread feeder, feeding the thread to the open-end friction spinning device.

A variety of designs are possible not only for the grabber, but also for the auxiliary conveying device. If, for example, a suction pipe is used as a grabber, the auxiliary conveying device for the fiber bundle is preferably also constituted by this suction pipe.

Independently of the design of the grabber, the auxiliary conveying device for the fiber bundle, in an alternate embodiment of the object of invention, can consist of a compressed air nozzle directed into the nip and installed on the side of the friction spinning elements which is opposite to the draw-off.

Another embodiment of the auxiliary conveying device is not dependent upon an air stream but is constituted by a thread-like profiling of at least one of the friction elements.

To ensure that the friction spinning elements exert sufficient retention force upon the thread being formed during the spinning process and despite the transporting effect of the friction spinning element's profile, a further embodiment in accordance with this invention provides that the lead of the thread-like profile be coordinated with the thread draw-off speed and with the rotational speed of the friction spinning devices so that the transporting speed achieved by the thread-like profile is lower than the draw-off speed of the thread.

The process as well as the device according to this invention make it possible to piece in a simple manner and without piecing thread. This is especially advantageous for starting the winding of a newly inserted empty tube, as the preparations to ready a piecing thread which are normally required, as well as the mechanical and time expenditures associated therewith, are no longer necessary. Repair of thread breakage is also possible without the normally required piecing thread which is fed back from the bobbin and is introduced into the spinning device, so that it is merely necessary to combine the thread extending toward the bobbin with the newly spun thread in a known manner. On the other hand, further aspects of this invention leave the possibiity open of working without piecing thread when piecing at the start of a bobbin winding and of working with a piecing thread fed back from the bobbin to the spinning aggregate in the conventional manner for the repair of thread breakage. Rational piecing under all operating conditions thus becomes possible.

BRIEF DESCRIPTION OF THE DRAWINGS

Examples of embodiments of the invention are furthermore explained in conjunction with the appended drawings, in which.

DETAILED DESCRIPTION OF THE PREFERRED EMBODIMENTS

Figure 1:
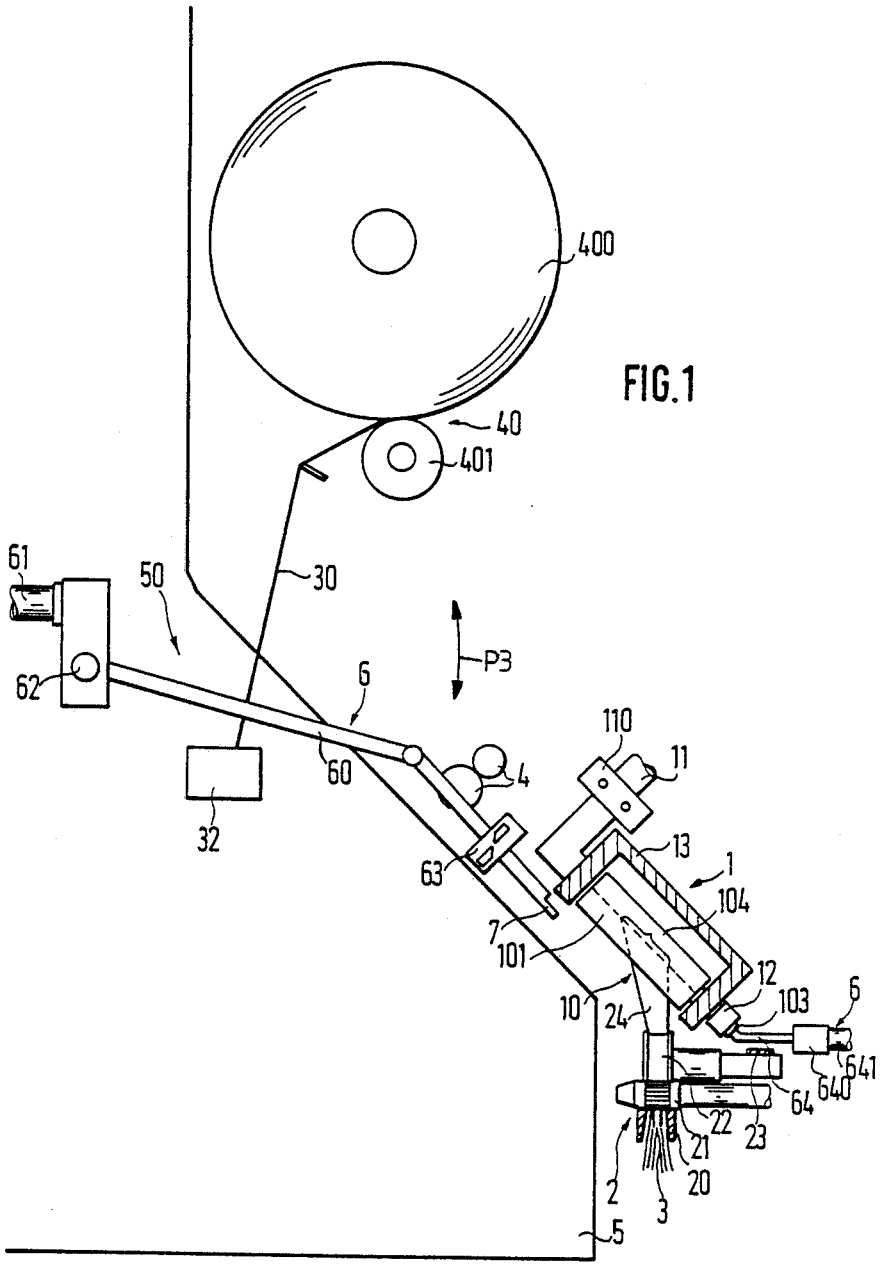
FIG. 1 is a schematic side-view of a spinning device in accordance invention, with an open-end friction spinning device and a pneumatic grabber.

FIG. 1 shows an open-end friction spinning device 10 to which the fiber material 3 is fed by means of a feeding and openign device 2. A draw-off device 4 draws off the spun thread 30. The thread drawn off is wound on a bobbin 400 by means of winding device 40 which bobbin can be driven by a bobbin roller 401.

The open-end friction spinning device 10 and the feeding and opening device 2 are installed in a stationary manner at the spinning station 1, of which a plurality are normally installed next to each other in a machine. A service carriage 5 with a piecing device 50 travels alongside these spinning stations 1.

The open-end friction spinning device 10 is equipped with a housing 13 with two rotationally symmetrical friction spinning elements 100 and 101 (FIG. 4) which form a nip 102. At least one of the friction spinning elements, e.g. friction spinning element 101, is perforated and is subjected to suction in the area of nip 102 during spinning. For this purpose it is connected via a valve 110 to a suction air line 11 (FIG. 1).

Figure 4:
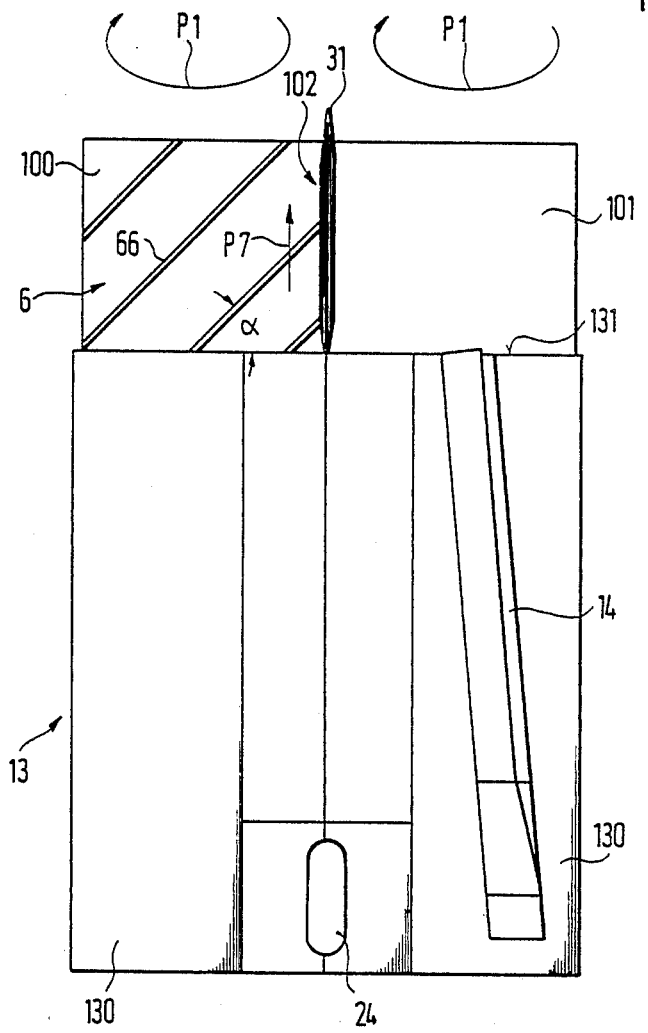
FIG. 4 is a front view illustrating details of the friction spinning device shown in FIG. 3.

The two friction spinning elements 100 and 101, which are rollers in the embodiment shown, are driven in the same direction (see arrows P1 in FIG. 4). For this purpose each of the friction spinning elements 100 and 101 is equipped with a wharve 103 which is driven by means of a drive belt 12. The manner in which this belt is driven in not shown here.

The feeding and opening device 2 which precedes the open-end friction spinning device 10 is equipped with a feeding funnel 20, by means of which the sliver-shaped fiber material 3 is fed to a feeding roller 21, working in coodination with a pressure roller or feeding trough (not shown) in the conventional way. The fiber material 3 is fed from the feeding roller 21 to an opening roller 22 which opens the sliver-shaped fiber material into individual fibers. The opening roller 22 is driven in a known manner by a belt 23. A fiber feeding channel 24 extends from the opening roller 22 to the nip 102 of the friction spinning elements 100, 101.

The service carriage 5 carries an auxiliary conveying mechanism 6 for a fiber bundle 31 (FIG. 4), which is formed in the nip 102, as is described in greater detail further below. This auxiliary conveying device 6 consists of a suction pipe 60 in the embodiment shown in FIG. 1. This suction pipe is connected to a suction line 61 and is bearingly supported and pivotable around an axis 62.

The mouth 70 of the suction pipe 60 constitutes a movable grabber 7 to seize the thread 30 leaving the nip 102 of the friction spinning elements 100, 101.

In front of mouth 70 of the suction pipe 60 a twist brake 71, consisting of a sieve 710 and capable of being subjected to negative pressure is provided. When the suction pipe 60 is in position to receive the fiber bundle 31 emerging from the nip 102, the sieve surface of sieve 710 extends parallel to the conveying direction of the fiber bundle being delivered from the nip 102 to the suction pipe 60.

Figure 2:
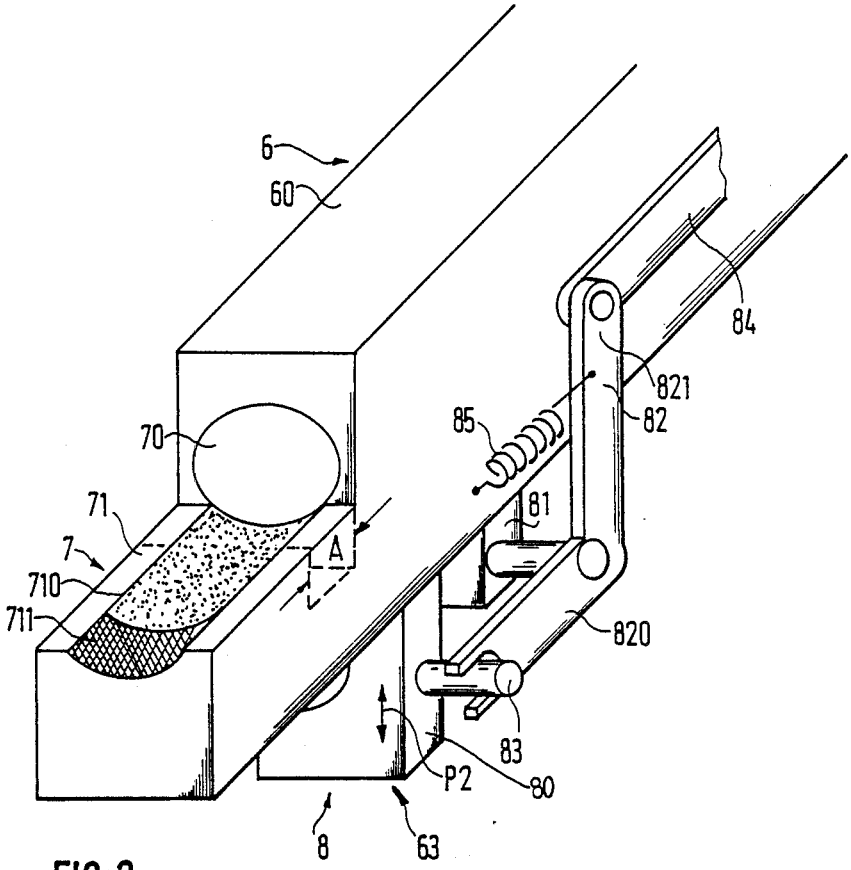
FIG. 2 shows details of the grabber shown in FIG. 1, in perspective.
Figure 5:
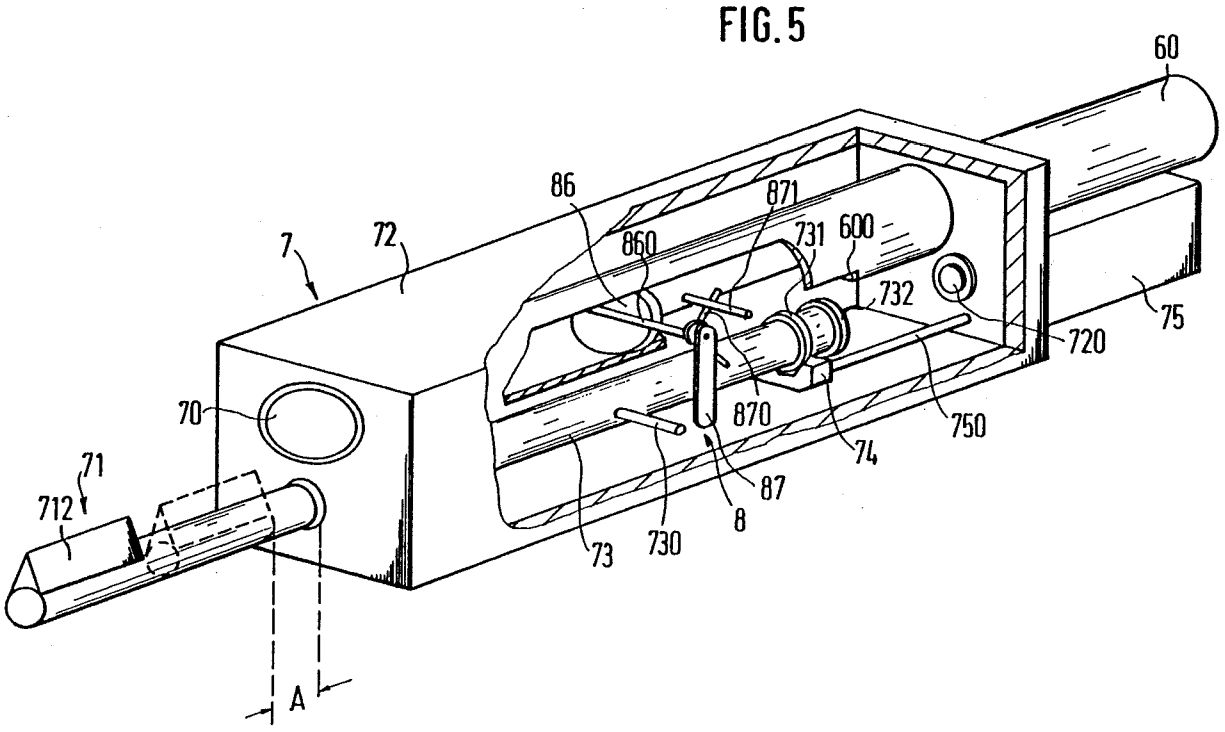
FIG. 5 is a variation in accordance with this invention of the grabber shown in FIG. 2, in perspective.

To switch over the negative pressure from mouth 70 of the suction pipe 60 to the twist brake 71 and vice versa, from the twist brake 71 to the mouth 70 of the suction pipe 60, a controllable switch-over device 8 is provided as shown in FIGS. 5 and 2. The switch-over device 8 is equipped with a closing element 80 (FIG. 2) which can be adjusted along the path of arrow P2. In the shown embodiment, the closing element 80 is constituted by a slide that lays open mouth 70 in the position shown and which closes it in the other position. For this purpose the suction pipe 60, in the shown embodiment, is equipped with a bearing 81 for a knee lever 82, one end 820 of which encompasses a bolt 83 located on the side of closing element 80 and the other end 821 of which is connected to a switching rod 84. The knee lever 82 is put under tension by draw spring 85 so that when the switching rod 84 is released, the closing element 80 lays open mouth 70 of the suction pipe 60. The switching rod 84 is controlled in a manner not shown here.

The device described above functions as follows:

When the machine stops or when bobbins are to be replaced, the service carriage 5 travels to spinning station 1 which is to be pieced to. This action can be prompted by a signal which is activated in a known manner when a thread breakage occurs at the spinning station in question, or it can be initiated by the arrival of the service carriage 5 to spinning station 1 where it effects the piecing operation.

Figure 3:
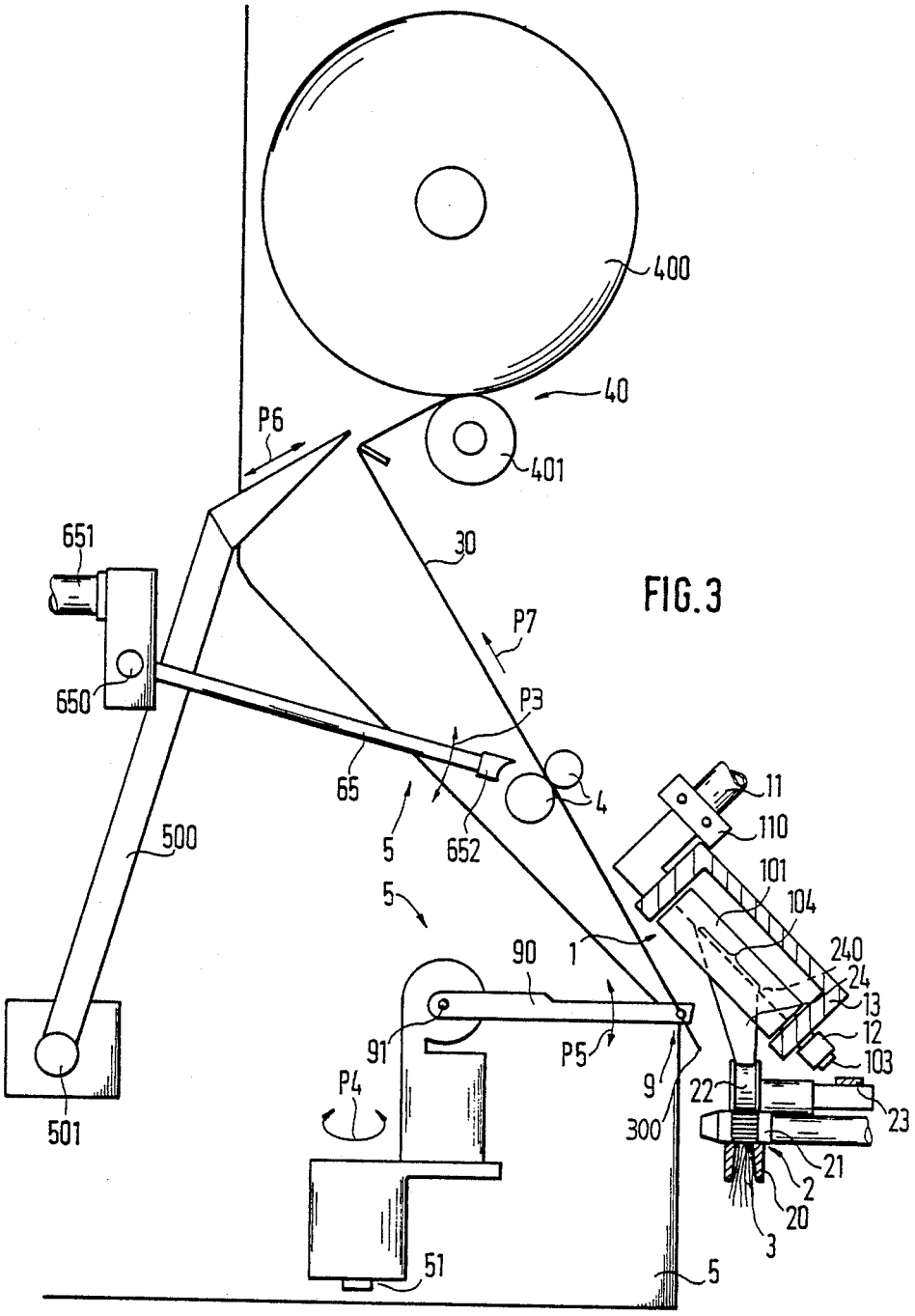
FIG. 3 is a schematic side-view of a variation in accordance with this invention of the device shown in FIG. 1, equipped with a mechanical grabber.

The friction spinning elements 100, 101, which were stopped until then, are again driven by belt 12 in a known manner. At this point in time the negative pressure which previously had been switched off is again applied to the friction spinning elements 100, 101 by means of valve 110. Fiber feeding is then switched on in the known manner. The fiber sliver now reaches nip 102 in form of individual fibers and is twisted into a fiber bundle 31 in a thread forming zone 104 (FIGS. 1 and 3). This fiber bundle 31 at first merely constitutes a comparatively loose fiber combination, since it is unimpeded in following the rotation to which the friction spinning elements 100, 101 are subjecting it.

As soon as a sufficient quantity of fibers has been fed into the nip 102 and as soon as the fiber bundle 31 contains the fiber mass which is required for piecing, fiber feeding into the nip 102 is again switched off. Negative pressure is then produced at the draw-off side of the nip. For this purpose a suction air stream is activated inside suction pipe 60 by means of a valve (not shown) which takes effect as far as into the nip 102 and upon fiber bundle 31, drawing the latter partially out of the nip 102 in longitudinal direction. Depending upon the material used and upon the prevailing negative pressure etc., the partial extraction of the fiber bundle 31 from nip 102 can be effected by the opened mouth 70 of suction pipe 60. When the leading end of the fiber bundle 31 has reached the sieve 710, negative pressure can be switched off at the mouth 70 by means of a switch-over device 8 and can be applied to sieve 710. Alternately, it is also possible to apply negative pressure to sieve 710 from the very beginning. The negative pressure at sieve 710 seizes fiber bundle 31 and aspires it against said sieve 710, thus preventing said fiber bundle 31 from continuing to follow the rotation which is imparted to it by the friction spinning elements 100, 101.

Suction pipe 60 is now drawn off slowly from the nip 102 of friction spinning elements 100, 101, so that the fiber bundle 31 can be deposited over the entire length of sieve 710.

The leading end of the fiber bundle 31 which is prevented from rotating causes the following end of the fiber bundle 31 which is still in nip 102 of the friction spinning elements 100, 101 to be subjected to true twisting. Fiber bundle 31 is thus enabled to incorporate fibers. For this reason, fiber feeding into nip 102 is now switched on again. Following this application of fiber bundle 31 against the twist brake 71, said fiber bundle 31 is released through switchover of the switch-over device 8. After this temporary application of fiber bundle 31 against twist brake 71 the newly forming thread 30 is now aspired into suction pipe 60 and is thus drawn off until the aspired length of thread can be held securely by suction pipe 60.

In timely coordination with the above-described processes, bobbin 400 is again lowered upon bobbin roller 401. Bobbin 400 thus starts to rotate in the direction of draw-off. Suction 60, together with thread 30 which it holds, is now swivelled towards winding device 40 (arrow P3). The thread 30 being formed is then transferred by the movable grabber 7 to the draw-off device constituted by the winding device 40 which forms the thread.

Once thread 30 has been transferred to the empty tube inserted in winding device 40, the tension in thread 30 increases. Due to this winding tension in thread 30 and/or due to corresponding control of the pressure roller of draw-off device 4, thread 30 is inserted into draw-off device 4 and is now drawn off from the nip 102 of friction spinning elements 100, 101.

To avoid an excessively long thread end when the thread 30 (drawn off from nip 102) is transferred, the grabber 7 is equipped with a thread cutting device 63, installed behind grabber 7 inside suction pipe 60 in the example shown. The excess thread length, together with fiber bundle 31, can thus be cut from the remainder of thread 30 and can be taken away at the time of transfer of thread 30 to the winding device 4. The thread cutting device 63 can be a separate device (FIG. 1); however, it can also be constituted by the switch-over device 8, and for this purpose the edge of the closing element 80 works together with a stationary edge of the suction pipe 60.

The temporary and intermediate interruption of fiber feeding during pneumatic conveying of the fiber bundle 31 into the range of twist brake 71 serves to prevent aspiration and thus loss of fibers. Because of the conveying air stream, these fibers or a majority of them could otherwise no longer be deposited into nip 102 but would leave thread forming zone 104 in direction of the suction pipe 60 before they can be deposited.

In the embodiment described, the twist brake 71 is constituted by a sieve 710; in addition to or instead of the sieve 710, a thread application surface 711 with a high friction coefficient can also be provided to serve as twist brake 71 (see FIG. 2); this high friction coefficient can be obtained by appropriate surface roughness, by an appropriate configuration or choice of material for the thread application surface 711.

In the embodiment shown in FIG. 1, a compressed air nozzle 64, connected to a compressed air line 641 via a valve 640, is located opposite the draw-off side of the friction spinning elements 100, 101. This compressed air nozzle 64 constitutes, as an alternative of suction pipe 60 or in addition to same, an auxiliary conveying device 6 for fiber bundle 31. A stream of compressed air is produced on the side of nip 102 which is opposite the draw-off side by controlling valve 640 in order to partially blow the fiber bundle 31 out of nip 102, so that the leading end of fiber bundle 31 comes within range of grabber 7 which seizes it. As for the pneumatic conveying of the fiber bundle 31 by means of suction air, fiber feeding is also switched off during the pneumatic conveying of this fiber bundle 31 by means of compressed air.

When the described device is to be used in connection with the repair of a broken thread, a thread connecting device 32 can be brought into proximity of the thread path between the friction spinning elements 100, 101 and the winding device 40, as is shown in FIG. 1. This is achieved by installing the thread connecting device 32 in the service carriage 5 so that it can be brought towards the path of the thread, or by bringing the path of the thread towards the thread connecting device 32. Thread connecting device 32 can be made as a knotting or splicing device, as desired.

In the open-end friction spinning device, in order to repair thread breakage by means of the device described above, the newly pieced thread 30 is fed to the thread connecting device 32 by means of suction pipe 60 which also doubles as a draw-off device. Furthermore, the thread is drawn off from bobbin 400 in a known manner and is also fed to the thread connecting device 32, where the two thread ends are connected to each other.

The thread cutting device 63 is located directly next to the grabber 7, as shown in FIG. 1, but this is not essential. It is quite possible to install such a cutting device 63 at any point within suction pipe 60.

A twist brake 71, consisting of a controllable sieve 710 and/or a thread application surface 711 with increased friction coefficients acting upon fiber bundle 31 has been described. Other designs can be used instead of the twist brakes 71 described. For example, sieve 710 need not be subjected to suction; instead, a needle cushion, controlled from a switching rod 84 can emerge through the sieve openings or can be retracted into said sieve 710. This grabber then consists of two elements moving towards each other (sieve 710 and needle cushion). With the needle cushion in action, a fiber bundle 31 can be held by the grabber (holding position), while said fiber bundle 31 is released when the needle cushion is retracted (releasing position).

The closing element 80 too can of course be made in a different way, for example as a rotating closure, whereby the controls of the closing element can also be mechanical, electrical or of some other nature.

According to FIG. 1 the fibers are spun within the nip to which they are fed through fiber feeding channel 24. Fiber feeding channel 24 and thread forming zone 104 are thus located on the same side of the clamping line of the friction elements 100, 101. To avoid loss of fibers, this side is covered during spinning by a cover (not shown), rendering the thread forming zone 104 inaccessible.

It is however also possible for the thread forming zone 104 to be located in the nip of friction spinning elements 100, 101 which is on the opposite side, in relation to the clamping line between the friction elements, of the nip on the side of the fiber feeding channel 24 (see German patent application P 35 24 942.0). The conditions of air pressure in the fiber feeding channel 24 are not influenced, in that case, by the fact of whether the fiber forming zone 104 is covered or not. A cover of such a fiber forming zone 104 can thus be dispensed with. This is the basis for a design of the grabber 7 as shown in FIG. 5.

Suction pipe 60 is again equipped with a mouth 70. A switch-over device 8 is located in the suction pipe 60. This switch-over device is equipped with a closing organ in form of a butterfly valve 86, pivotable around an axis 860 supported within the suction pipe 60. The bearing support of the axis 860 cannot be seen in FIG. 5 as the suction pipe 60 and the housing 72 which surrounds the forward end of the suction pipe 60 are cut off in the drawing for the sake of illustration clarity. A lever 87, held by tension spring 870, is installed at the free end of axis 860 and holds butterfly valve 86 in its closed position when said lever 87 is released. Torsion spring 870 bears therefore with one end upon lever 87 and with its other end upon a pin 871 which is held in the wall of the housing 72, cut off in the drawing.

Housing 72 is supported by the suction pipe 60 and accepts the rear end of a pipe 73 which accepts the twist brake 71 at its other end. Pipe 73 is equipped with a bolt 730 extending radially outward and which, in its shown left end position releases lever 87 while in its right end position it turns the lever 87 in a counterclockwise direction and thus opens butterfly valve 86.

The rear end of pipe 73 carries two rings 731 and 732, between which a fork 74 encompasses the pipe. Fork 74 is connected to anchor 759 of a solenoid 75.

Housing 72 is equipped with a seal 720 in the area in which pipe 73 abuts on it.

The pipe 60 is provided with an oblong recess 600 inside housing 72, on its side toward pipe 73. This recess 600, in relation to the butterfly valve 86, is located on the side of suction pipe 60 which is away from mouth 70.

If pipe 73 is in its shown position, which is the receiving position, the rear end is released by seal 720 so that the air sucked in through the twist brake 71 flows through pipe 73 and through recess 600 into suction pipe 60. Butterfly valve 86 is closed in this position, so that no air can be sucked in through mouth 70.

The twist brake 71, at the forward end of the pipe 73 which is here closed at the front is provided with a roof-shaped sieve 712. Sieve 712 is configured so that it may be positioned as deeply as possible into the nip, close to the thread forming zone 104.

To receive the piecing joint, grabber 7, together with twist brake 71, is brought from the side to close proximity of the thread forming zone 104. In the course of this swivelling movement the solenoid 75 is excited and thereby brings pipe 73 out of its closing position (in which it adheres to seal 720) into the position shown in FIG. 5. Twist brake 71 is thus subjected to negative pressure and aspires the piecing joint. By moving away grabber 7 from the thread forming zone 104, the piecing joint and the newly forming thread are now drawn off from the friction spinning elements 100, 101. By interrupting the power supply to the solenoid 75 (by means of a readjusting spring) or through pole reversal of the solenoid, pipe 73, together with twist brake 71, is now pulled in direction of housing 72. Bolt 730 which goes to lever 87 thereby opens butterfly valve 86, while pipe 73 which goes to seal 720 eliminates the stream of suction air in pipe 73 and thus at the twist brake 71. The suction air stream which now takes effect once more at mouth 70 of suction pipe 60 draws the piecing joint, together with the pieced and newly formed thread from the twist brake 71.

The twist brake 71 which can be adjusted in relation to the mouth 70 of suction pipe 60 can also be used with a twist brake 71 designed as shown in FIG. 2, with thread forming zone 104 and fiber feeding channel 24 being located on the same side of the friction spinning elements 100, 101. This facilitates moving the twist brake 71 towards the friction spinning elements 100, 101, in particular if limited space is available because of the suction air line 11.

As shown in FIG. 5, the twist brake 71, in its transfer position, leaves a distance A between sieve 712 and the mouth 70 of suction pipe 60. In this way, aspired air can flow from all sides as well as in an axial direction towards mouth 70. An air stream directed against the sieve thereby acts upon the piecing joint held by sieve 712, so that the suction pipe 60 can take over the piecing joint and the following thread without any problem.

In order to ensure that mouth 70 of the suction pipe 60 shown in FIG. 2 is also surrounded by a clearance, provisions can be made for the sieve 71 to end at a distance A from mouth 70 of suction pipe 60 by means of a slit (see broken-line indication in FIG. 2).

Many variations are thus possible for achieving the object of the instant patent application. Further variations, by exchanging characteristics among each other or by replacing them by equivalents or combinations thereof are also possible and fall within the framework of the instant invention. FIG. 3 shows an example of such a variant, in which the pneumatic grabber 7 has been replaced by a mechanical grabber 9. Grabber 9 is seated on the free end of an arm 90 which is supported on service carriage 5 so that it can pivot around a first axis 51 in a first, horizontal swivelling movement (arrow P4) and around a second axis 91 in a second, vertical swivelling movement (arrow P5).

Grabber 9 can, for example, be made in form of a controllable, known thread clamp with two clamping elements which can be brought alternately into a holding position in which both clamping elements closely adhere to each other, or into a releasing position in which they are at a distance from each other.

The grabber 9 is equipped with a pivotable suction pipe 65 serving as a draw-off device, which is pivotably supported on a horizontal axis 650 so that it can be swivelled in a vertical plane (arrow P6) from a receiving position near grabber 9 into a transfer position near bobbin 400. Suction pipe 65 is connected to a source of negative pressure (not shown) via a suction line 651.

In this embodiment too, the compressed air nozzle 64 shown in FIG. 1 can be used as the auxiliary conveying device.

When the fiber bundle 31 has partially left the draw-off end of the nip 102 between the friction spinning elements 100, 101, it comes within range of grabber 9. The latter is now brought into holding position, so that the fiber bundle 31 is held between the two clamping elements which prevent its rotation so that new fiber fed to the nip 102 can be incorporated into the back end of the fiber bundle 31. The grabber 9, together with the clamped fiber bundle 31 and with the following, newly formed thread 30, is brought in front of the mouth 652 of the suction pipe 65 which aspires the thread 30. The grabber 9 is now brought into its releasing position so that the fiber bundle 31 enters the suction pipe 65 in addition to the newly formed thread 30. When the length of the thread 30 sucked into the suction pipe 65 is sufficient to ensure secure holding, suction pipe 65 is swivelled into a transferring position toward a winding device 40 and the thread is transferred to the empty tube which was inserted in the meantime. This transfer is executed in the conventional manner, for example by means of a catch on the winding device 40 (not shown).

In this device too, repair of thread breakage can be effected by feeding the fiber bundle 31, together with the following thread to a thread connecting device 32 (see FIG. 1), while another end of a thread drawn off from bobbin 400 is also fed to the thread connecting device 32 to be connected with the thread which extends to the friction spinning device.

If a thread connecting device 32 is to be dispensed with, thread breakage can also be repaired in the usual manner by means of a thread 30, drawn off from bobbin 400; however, this does not affect the possibility of piecing without such an auxiliary piecing thread when a bobbin winding is started and when normally no piecing thread is available.

If a suction pipe 60 is provided, as shown in FIG. 1, its mouth 70 can also be used in case of thread breakage to draw off thread 30 from bobbin 400 and to feed it back to the friction spinning device 10 in the known manner. In this case the grabber 7, constituted by mouth 70 of suction pipe 60, also functions as a thread feeder to the open-end friction spinning device 10.

Another such device is explained through FIGS. 3 and 4. The piecing device 50, installed on the service carriage 5, is equipped with a suction pipe 500 capable of being swivelled against bobbin 400 (arrow P6), by means of which suction pipe 500 a thread end can be aspired from the bobbin 400. Bobbin 400 can be driven in the known manner from service carriage 5 in the unwinding direction so that the aspired thread end enters further and further into the suction pipe 500. Suction pipe 500 is provided with an oblong slit (not shown) in its side toward spinning station 1 so that the aspired thread segment can assume a stretched course between the slit end away from bobbin 400, near swivelling axis 501 of suction pipe 500, and bobbin 400. In this way, thread 30 comes within swivelling range of arm 90 which is equipped with the controllable grabber 9, fashioned in this embodiment as a thread feeder to the open-end friction spinning device 10.

FIG. 4 shows housing 13 from its side toward grabber 9, on which it is covered by means of a cover 130. Cover 130 is provided with a thread insertion slit 14. This slit extends from the outside of cover 130 up to its inside and extends in a parallel manner to the fiber feeding channel 24, from the draw-off end 131 of the housing 13 up to the mouth end 240 of the fiber feeding channel 24 which is away from the drawoff side (FIG. 3). Since the thread insertion slit 14 is located side by side with the fiber feeding channel 24, it ends at the side of fiber feeding channel 24 and thus outside nip 102 and across from friction spinning element 101, on the inside of housing 13.

The device described above in its structure operates as follows:

To effect piecing, the service carriage 5 travels to the spinning station 1 concerned. Here, suction pipe 500 is swivelled around its swivelling axis 501 against a bobbin 400 which was previously lifted away from bobbin roller 401. While bobbin 400 is driven in unwinding direction from service carriage 5 by means of a drive roller (not shown), suction pipe 500 receives the unwound thread 30. Once a sufficient length of thread has been sucked into suction pipe 500, bobbin 400 is stopped and suction pipe 500 is swivelled away from bobbin 400. At the same time thread 30 emerges from the above-mentioned longitudinal slit of suction pipe 500. It then assumes a stretched position between the end of the longitudinal slit on the side of swivelling axis 501 and bobbin 400. Thread is thus located within the swivelling range of the horizontally and vertically swivelling grabber 9. The latter is brought into a thread receiving position within the course of the thread and there receives thread 30. It conveys thread 30 to a cutting device (not shown) installed in the service carraige, which cuts thread 30 on the side of grabber 9 which is away from bobbin 400. At the same time a definite thread length, as required for piecing, is created between grabber 9 and the free thread end. Grabber 9 is then swivelled by means of a combination of horizontal and vertical movement toward the open-end friction spinning device 10. It is then in a thread transferring position in front of thread insertion slit 14 and presents thread end 300 to said slit. At the same time it holds thread 30 in an essentially parallel position to thread insertion slit 14.

During this feed-back of the thread 30 to its piecing position in front of thread insertion slit 14, the friction spinning elements 100, 101, which had previously been stopped, are again made to rotate. Furthermore, the previously switched-off negative pressure is again applied to the friction spinning elements 100, 101 by means of valve 100. Also, fiber feeding is switched back on in the known manner. The fiber sliver now arrives into nip 102 in form of individual fibers and there is twisted to form a fiber bundle 31 within fiber forming zone 104.

The suction air stream flowing through the friction spinning element 101 causes the thread end in front of thread insertion slit 14, outside nip 102, to reach the circumferential surface of friction spinning element 101 which is subjected to suction. The negative pressure at the circumferential surface causes the thread end to be carried along by friction spinning element 101 which rotates in the direction of nip 102 and to be deposited on the rotating fiber bundle 31. Fiber bundle 31 is now twisted into the thread end.

Draw-off of the now newly forming thread 30 from the thread forming zone 104 is effected through the continuation of the movement of arm 90, together with grabber 9, and, depending on piecing speed, fiber material, etc., can be effected after interruption of the feeding and presentation movement of the grabber 9 or also in continuous continuation of this feeding and presentation movement.

Different designs of a mechanical grabber 9 are possible. For example, grabber 9 can be designed so as to transfer thread 30, together with fiber bundle 31, directly to bobbin 400. Grabber 9 can then be provided with a separating device which separates fiber bundle 31 from the remainder of the thread during transfer of thread 30 to the winding device 40.

It is possible to fashion the movable grabber 9 simply as a burring garniture or similar device, from which the fiber bundle 31 and the following thread is taken by pneumo-mechanical means (through the swivelling motion of a suction pipe 65) or by mechanical means, by winding device 40. In that case the grabber 9 need not have elements capable of moving toward each other. In another variant, grabber 9 can also be installed in a stationary position in front of the draw-off end of the nip 102, whereby a scraper, which is movable crosswise to the path of the thread can be provided between friction spinning device 10 and grabber 9 for the transfer of thread 30 to a pneumatic transferring device (similar, for example, to suction pipe 65).

If a pneumatic auxiliary conveying device 6, as described above in the example of suction pipe 60 and compressed air nozzle 64 is used, fiber feeding must be temporarily interrupted while the fiber bundle 31 is being conveyed into receiving position, as the fibers would otherwise also be seized by the air stream. As shown in FIG. 4, the friction spinning element 100 is therefore provided with a screw-like profile 66 consisting of channels, ribs or similar treatment. This profile 66 is oriented in thread draw-off direction (arrow P7), i.e. the channels or ribs keep moving closer to the draw-off end of friction spinning element 100 during rotation.

During rotation of the friction spinning elements 100, 101 the profile 66 imparts to the fiber bundle 31 a forward movement in direction of arrow P7 so that it finally emerges with its forward end from nip 102, there to be seized by a pneumatic or mechanical grabber 7 or 9. To prevent the profiling from drawing the forming thread 30 again out of nip 102 after successful piecing and to ensure that the draw-off speed of the thread should rather depend upon the speed of the drawoff device, the gradient of profile 66 is coordinated with thread draw-off speed and also with the rotational speed of the friction spinning elements 100, 101 so that the conveying speed generated by the screw-like profiling is lower than the draw-off speed of the thread. To avoid the necessity of replacing friction spinning element 100 against one with a different profile gradient each time spinning conditions are changed, the gradient a is designed for the maximum speed to occur. Since the spinning process itself has not yet begun while the fiber bundle 31 is being conveyed into the receiving zone of grabber 7 or 9, the steepness of the gradient a plays only a secondary role, as the size of fiber bundle 31 to be conveyed to grabber 7 or 9 can be influenced through appropriate control of fiber feeding.

As is shown, either one friction spinning element 100 alone or both friction spinning elements 100, 101, as desired, can be equipped with such a profile 66. Also, if desired, a pneumatic auxiliary conveying device in combination with a mechanical auxiliary conveying device can be provided. Neither is the utilization of a particular type of auxiliary conveying device 6 tied to the particular configuration of grabber 7 or 9.

What is claimed is:

1. Process for piecing to an open-end friction spinning device having two friction spinning elements driven in the same direction and forming a nip, with fibers being fed into a thread forming zone of such nip and subsequently drawn off from such thread forming zone in the form of a continuous thread, said process including feeding fibers into the nip to be twisted into a fiber bundle, grasping such fiber bundle and securing one end thereof against rotation so that the remainder of the bundle is twisted with fibers entering said nip incorporated thereinto, withdrawing said fiber bundle from said thread forming zone with the thread end which is secured against rotation forming the leading end of said thread, while simultaneously twisting-in fibers in the remainder thereof to form a thread which is withdrawn and transferred to a winding device.

2. Process as in claim 1, further wherein the fiber bundle is separated from the remaining thread formed in the nip before transfer of such thread to the winding device.

3. Process as in claim 1, further wherein said fiber bundle is partly conveyed out of said nip in its longitudinal direction before being grasped.

4. Process as in claim 3, wherein fiber feeding is temporarily switched off after formation of the fiber bundle; subsequently the fiber bundle is conveyed pneumatically and partially out of the nip of the friction spinning elements, is grasped there, and is secured against rotation at its leading end; and fiber feeding is then switched on again, and newly produced thread is drawn off from the nip.

5. Process as in claim 4, wherein the fiber bundle is partially drawn out of the nip by means of a suction air straem action at a draw-off side of the nip, its leading end is temporarily applied to a twist brake after leaving the nip and then released from the twist brake so that the newly produced thread is then drawn off from the nip.

6. Process as in claim 4, wherein a compressed air stream is produced on the draw-off side of the nip on an end of such nip away from draw-off, and the fiber bundle is conveyed out of the nip by being partially blown out of the nip so that it can be grasped.

7. A device for piecing on an open-end friction spinning machine including a pair of friction spinning elements defining a spinning nip therebetween for forming thread from fibers fed thereinto, to be drawn off by draw-off rollers and wound onto a bobbin, said apparatus comprising:

an auxiliary conveying mechanism for controllably at least partially displacing a fiber bundle residing in the machine spinning nip from such nip, at a time when thread is not being drawn therefrom and wound onto a bobbin; and a grabber for seizing a leading end of the fiber bundle after having left the nip, so that the remaining length of said fiber bundle is twisted for the incorporation thereinto of fibers fed into said spinning nip for the formation of thread.

8. Device as in claim 7, wherein said grabber is equipped with a thread separating device for separating a leading-edge fiber bundle from newly formed thread tied in thereto.

9. Device as in claim 7, wherein said grabber is movable relative said auxiliary conveying mechanism and a draw-off device of the machine to which newly formed thread is transferred comprises a winding device.

10. Device as in claim 7, wherein said grabber includes a mouth of a suction pipe, in front of which a twist brake is installed for preventing the rotation of a fiber bundle leading end seized by said grabber.

11. Device as in claim 10, wherein said twist brake comprises a mechanical device.

12. Device as in claim 11, wherein said twist brake includes a thread support surface with a high friction coefficient.

13. Device as in claim 10, wherein said twist brake is fashioned as a sieve which can be subjected to negative pressure and which extends parallel to a conveying direction of the fiber bundle to said suction pipe when said suction pipe is in a defined receiving position thereof.

14. Device as in claim 13, wherein said suction pipe is equipped with a switch-over device for the alternating application of negative pressure to said sieve or to said mouth of said suction pipe.

15. Device as in claim 14, wherein said switch-over device further comprises a thread separating device for separating a leading-edge fiber bundle from newly formed thread tied in thereto.

16. Device as in claim 10, wherein said twist brake is cone-shaped so as to adapt to a thread forming zone of the nip defined by the machine friction spinning elements.

17. Device as in claim 6, wherein said twist brake can be shifted in relation to the mouth of said suction pipe.

18. Device as in claim 17 wherein the shiftable twist brake, in a transitory position thereof, is located at an axial distance relative the mouth of said suction pipe.

19. Device as in claim 10 wherein the nip has a thread forming zone on the side thereof opposite that of fiber feeding, and said mouth of said suction pipe is surrounded radially by a clearance.

20. Device as in claim 10 wherein said auxiliary conveying mechanism includes said suction pipe.

21. Device as in claim 7 wherein said grabber comprises a mechanical structure for physically securing a fiber bundle or newly formed thread.

22. Device as in claim 21, wherein said grabber includes at least two elements which can be moved in relation to each other so as to assume one of a holding position or a releasing position.

23. Device as in claim 22, wherein said grabber comprises a thread clamp.

24. Device as in claim 7, further comprising a thread connecting device which can be brought into the path of thread between the open-end friction spinning nip and a winding device for a bobbin associated therewith.

25. Device as in claim 7 wherein said grabber further comprises a device for alternatiely feeding thread wound on a bobbin back to the nip of the open-end friction spinning device.

26. Device as in claim 7 wherein said auxiliary conveying mechanism includes a compressed air nozzle directed into the machine spinning nip and which is located on a side of the friction spinning elements away from the draw-off side thereof.

27. Device as in claim 7 wherein said auxiliary conveying mechanism is formed by a thread-like profile of at least one of the friction spinning elements, said profile being oriented in the direction of drawoff for thread produced in the machine spinning nip.

28. Device as in claim 27, wherein the gradient $\alpha$ of said thread-like profile is selected in accordance with the draw-off speed of the thread and the rotational speed of the friction spinning elements so that a conveying speed, determined by said thread-like profile, is lower than such thread draw-off speed.

29. A method of piecing on an open-end friction spinning machine, such machine including a pair of friction spinning elements defining a nip therebetween for forming thread therein to be drawn off and wound onto a bobbin, said method including the steps of:

forming a fiber bundle in such nip;

securing against rotation one end of such fiber bundle so that true twisting is produced in the remaining length thereof for the incorporation thereinto of fibers fed into such nip;

drawing off said fiber bundle from said nip in a direction towards said one end thereof, therby forming thread as fibers fed into such nip are tied into such bundle; and winding same onto a bobbin so that newly formed thread follows said fiber bundle to be wound onto such bobbin, without requiring a piecing thread to be returned from the bobbin or otherwise produced.

30. A method as in claim 29, further including the step of trimming the fiber bundle from newly formed thread prior to winding same onto the bobbin so that only newly formed thread is wound thereon.

31. A method as in claim 29, further including the step of suspending fiber feeding to such nip until said one end of said fiber bundle has been secured against rotation.

32. A method as in claim 31, further including the step of partially conveying the fiber bundle from such nip so that said one end to be secured against rotation partially leaves said nip before being secured against rotation.

33. A method as in claim 29, further including the step of partially conveying the fiber bundle from such nip so that said one end to be secured against rotation partially leaves said nip before being secured against rotation.

34. A device for piecing on an open-end friction spinning machine including a pair of friction spinning elements defining a spinning nip therebetween for forming thread from fibers fed thereinto, to be drawn off by draw-off rollers and wound onto a bobin, said apparatus comprising:

an auxiliary conveying mechanism for controllably at least partially displacing a fiber bundle residing in the machine spinning nip from such nip; and a grabber associated with said auxiliary conveying mechanism for seizing a fiber bundle displaced thereby from the nip; further wherein said auxiliary conveying mechanism is movable, between a first position relatively adjacent the spinning nip and a second position relatively adjacent a bobbin, with said grabber received thereon for movement therewith, so that piecing of a fiber bundle to such bobbin with newly formed thread tied into such fiber bundle can be selectively accomplished without requiring a piecing thread to be returned from such bobbin.

35. An open-end spinning machine for piecing thread newly produced thereby to one of a bobbin and draw-off rollers, said machine comprising:

a pair of friction spinning elements forming a spinning station, said elements being rotatably driven in the same direction and defining a spinning nip therebetween for forming thread in a thread forming zone thereof;

fiber feeding means for controllably feeding fibers to said spinning nip to be formed into thread;

draw-off rollers for drawing off thread formed in said nip and directing same to a rotatable bobbin to be wound thereon;

bobbin drive means for controllably rotating such bobbin;

auxiliary conveying means for controllably at least partially conveying a fiber bundle from said thread forming zone, said auxiliary conveying means being controllably movable between a grasping position relatively adjacent said spinning nip and a transfer position selectively relatively adjacent one of such bobbin and said draw-off rollers; and grabber means, supported on said auxiliary conveying means for movement therewith, for controllably grasping and subsequently releasing a fiber bundle conveyed from said nip, whenever said auxiliary conveying means is in said grasping and said transfer positions, respectively; wherein a fiber bundle with newly formed thread tied thereinto is directly conveyed, grasped, and transferred to one of such bobbin and said draw-off rollers, without requiring formation of a separate piecing thread or withdrawal of a piecing reserve from such bobbin.

36. A machine as in claim 35, wherein:

said auxiliary conveying means includes a suction tube, the position of which is controllable between said grasping and said transfer positions; and said grabber means includes a suction-actuated twist brake adjacent a mouth of said suction tube; said machine further including a suction source, and controllable switch-over means for selectively directing suction therefrom between one of said suction tube, for conveying a fiber bundle from the machine spinning nip, and said twist brake, for grasping the fiber bundle so conveyed from such nip.

37. A machine as in said claim 35, wherein said transfer position is relatively adjacent said draw-off rollers so that a fiber bundle and newly formed thread tied thereinto is directed through such rollers towards the bobbin to be transferred thereto and to be wound thereon.

38. Apparatus for piecing on an open-end friction spinning machine including a pair of friction spinning elements defining a spinning nip therebetween for forming thread from fibers fed thereinto, to be drawn off by draw-off rollers and wound onto a bobbin, said apparatus comprising:

a grabber for seizing a fiber bundle residing in the machine spinning nip;

means for imparting a movement to said grabber to withdraw said fiber bundle at least partially out of said nip;

draw-off means for drawing off the thread which is formed as a continuation of said fiber bundle; and means for transferring said newly formed thread to said bobbin for being wound thereon.

39. Apparatus as in claim 38, further including:

an auxiliary conveying mechanism for controllably at least partially displacing said fiber bundle from such nip; wherein said grabber is adapted to seize a leading end of the fiber bundle after such leading end has left said nip.

* * * * *